US008230632B2

(12) United States Patent
Moretti

(10) Patent No.: US 8,230,632 B2
(45) Date of Patent: Jul. 31, 2012

(54) MODULAR PORTABLE WEAPON

(75) Inventor: Luigi Moretti, Brescia (IT)

(73) Assignee: Benelli Armi S.p.A., Via Della Stazione, Pesaro Urbino (IT)

( * ) Notice: Subject to any disclaimer, the term of this patent is extended or adjusted under 35 U.S.C. 154(b) by 234 days.

(21) Appl. No.: 12/217,774

(22) Filed: Jul. 8, 2008

(65) Prior Publication Data

US 2009/0019755 A1 Jan. 22, 2009

(30) Foreign Application Priority Data

Jul. 20, 2007 (IT) ..... MI2007A1473

(51) Int. Cl.
*F41A 21/00* (2006.01)

(52) U.S. Cl. ..... 42/75.01; 42/75.02

(58) Field of Classification Search ..... 42/75.01–75.1
See application file for complete search history.

(56) References Cited

U.S. PATENT DOCUMENTS 4,087,930 A * 5/1978 Grehl ..... 42/75.02
4,615,132 A 10/1986 Smith
4,878,308 A * 11/1989 Rose ..... 42/112
6,293,040 B1 * 9/2001 Luth ..... 42/75.01
6,484,430 B1 11/2002 Robinson et al.
6,971,202 B2 12/2005 Bender
7,275,342 B2 * 10/2007 Medvedeo ..... 42/19
7,428,795 B2 * 9/2008 Herring ..... 42/75.01
2003/0150151 A1 * 8/2003 Orth ..... 42/75.02
2005/0241211 A1 * 11/2005 Swan ..... 42/124
2006/0026883 A1 * 2/2006 Hochstrate et al. ..... 42/75.01
2006/0283067 A1 * 12/2006 Herring ..... 42/75.01
2007/0033851 A1 * 2/2007 Hochstrate et al. ..... 42/75.01
2007/0089347 A1 * 4/2007 Webber et al. ..... 42/75.03
2008/0190005 A1 * 8/2008 Rohrauer ..... 42/75.01
2008/0216377 A1 * 9/2008 Rohrauer ..... 42/75.01
2009/0000173 A1 * 1/2009 Robinson et al. ..... 42/75.02
2010/0071245 A1 * 3/2010 Lesenfants et al. ..... 42/75.01

* cited by examiner

*Primary Examiner* — Michael Carone
*Assistant Examiner* — Samir Abdosh
(74) *Attorney, Agent, or Firm* — R. Neil Sudol; Coleman Sudol Sapone, P.C.

(57) ABSTRACT

A modular portable weapon has a supporting module, constituted by the barrel of the weapon, and modules which are mutually functionally independent and are associated with the supporting module. The modular weapon according to the invention allows the user to compose the weapon by choosing, for example, a type of barrel, stock and tubular magazine among the alternatives that are commercially available, with the characteristics best suited to his requirements.

23 Claims, 11 Drawing Sheets

MODULAR PORTABLE WEAPON

BACKGROUND OF THE INVENTION

1. Field of the Invention

The present invention relates to a modular portable weapon.

2. Description of the Prior Art

Smoothbore or rifled portable weapons generally include a frame or receiver, which is made of steel or light alloy, for example Ergal. A magazine tube, containing a spring and a cartridge pusher, is generally screwed at the front of the receiver. A tube which contains a recoil spring, and onto which a stock is mounted, is attached to the rear of the receiver.

A barrel extension is generally accommodated within the receiver with the corresponding breech-lock for locking the firing chamber and a firing mechanism assembled on a trigger plate which is separate from the receiver.

The barrel is connected, by means of a barrel guiding ring, to the front end part of the magazine and is kept assembled thereon, together with the guide rod, by a threaded cap, which is screwed onto the magazine.

If one considers a traditional weapon as a whole, it is evident that when it is disassembled it breaks down into a series of components which do not maintain the prerogatives of independent modules having a specific function.

Indeed, by unscrewing the threaded cap, one disassembles for example the guide rod but not the magazine tube; if the barrel is disassembled from the receiver, the locking assembly is not disassembled simultaneously as well.

If the stock is disassembled, usually one finds oneself with a series of individual components which are not mutually connected and therefore can be lost easily; the same happens if the magazine tube is disassembled, and so forth.

In a traditional weapon, the supporting structure forms when the assembly constituted by the frame/receiver plus magazine tube and the assembly constituted by the barrel, sheath or barrel extension plus the barrel guiding ring is locked by screwing a fixing cap onto the magazine tube, restraining the typical vibrations of the barrel and producing potentially negative effects on the ballistics.

SUMMARY OF THE INVENTION

The aim of the present invention is to provide a novel modular structure of a portable weapon which overcomes the drawbacks of the cited prior art.

An object of the invention is to provide a modular portable weapon, with a smoothbore or rifled barrel, in which the modular parts are mutually independent, i.e., each is capable of performing its own function and all can be mutually assembled without requiring particular tools.

Another object of the invention is to provide a portable weapon which is simpler and more reliable, by reducing the number of its components and also combining them, in some cases, together so as to obtain new components which are substantially different from the ones known traditionally.

This aim and these and other objects which will become better apparent hereinafter are achieved by a modular portable weapon, characterized in that it comprises a supporting module, constituted by the barrel of the weapon, and one or more mutually independent functional modules.

BRIEF DESCRIPTION OF THE DRAWINGS

Further characteristics and advantages will become better apparent from the description of preferred but not exclusive embodiments of the invention, illustrated by way of non-limiting example in the accompanying drawings, wherein.

DESCRIPTION OF THE PREFERRED EMBODIMENTS OF THE INVENTION

Figure 1:
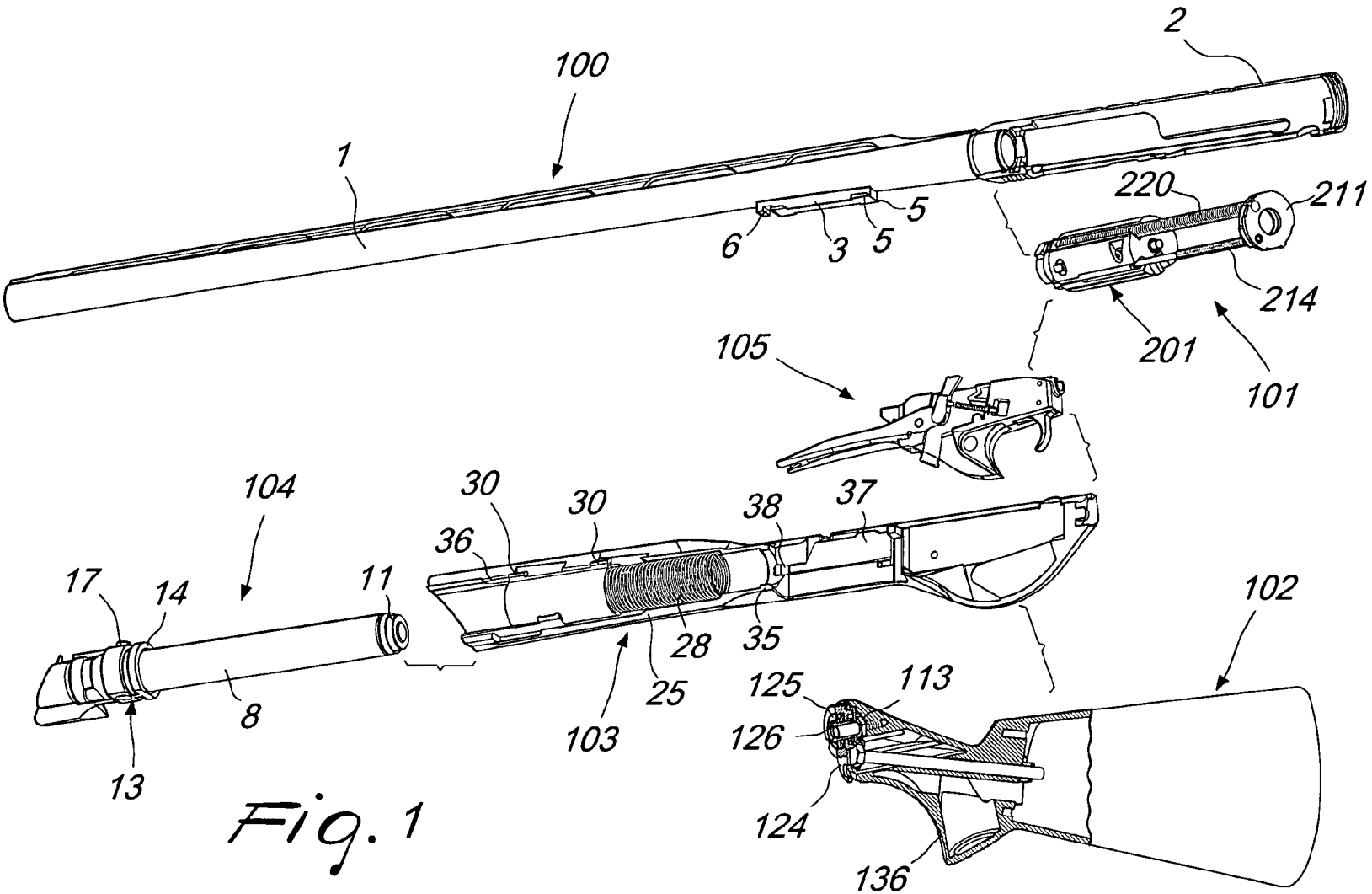
FIG. 1 is an exploded perspective view of the components of the modular portable weapon according to the present invention.

With reference to the cited figures, the modular portable weapon according to the present invention comprises a supporting module, generally designated by the reference numeral 100, a locking and recocking module with swivel breech-lock and rotating locking head, designated by the reference numeral 101, a stock or handle module 102, and a containment module 103, which is suitable to contain a magazine module 104 and a cartridge lifting and firing mechanism module, generally designated by the reference numeral 105.

The supporting module 100 is constituted by a barrel 1, which is provided with a sheath or barrel extension 2, and on which all the other modular components of the system are mounted.

The locking and recocking module with swivel breech-lock and rotating locking head 101 is mounted inside the sheath or barrel extension itself and is capable of performing all the functions for locking, opening, case ejection and recocking with return to locking required for correct operation of the weapon. All the moving components for locking and opening the firing chamber of the weapon, the swivel breech-lock mass, the recoil spring, the breech-lock recovery spring, the ejector and the corresponding spring are contained within the barrel extension and are not arranged in a dissociated manner as in traditional weapons.

The module 102, which constitutes the stock of the weapon, is mounted on the same supporting module formed by the barrel provided with a barrel extension. The stock or handle module can be of various kinds: pistol grip stock, stock with pistol handle, telescopic stock, et cetera, ensuring the possibility to easily obtain a weapon which is configured according to the various stock fitting requirements.

The containment module 103 is engaged on the supporting module 100 and the magazine module 104 is mounted therein and can be easily separated from the weapon by virtue of the complete lack of threads that are normally present in traditional weapons.

The availability of tubular magazines of different length ensures the possibility to easily have a weapon with a tubular magazine which contains a larger or smaller number of cartridges, depending on the various operating requirements.

The containment module 103 has the triple function of a forestock for gripping the weapon with one's hand, of a frame as a component for containing the firing mechanism of the weapon and of the system for the exit and lifting of the cartridges of the magazine, and of trigger plate as a trigger protection component. This new component is simply engaged with the supporting module 100, which is formed by the barrel with its sheath or barrel extension, without requiring screws or threaded caps but only by means of claws which are formed on a sliding sleeve, which is mounted at the front inside it and through an interlocking coupling on a plate of the stock module which is rigidly coupled to the rear part of the sheath or barrel extension itself.

The firing module 105 is mounted inside the containment module 103, at the trigger plate molded monolithically therein. The magazine module 104 is simply accommodated at the front, inside the containment module 103, and passes inside the sleeve that anchors it to the barrel. The magazine 103 is then engaged with the barrel.

The modules are now described in greater detail.

Figure 11:
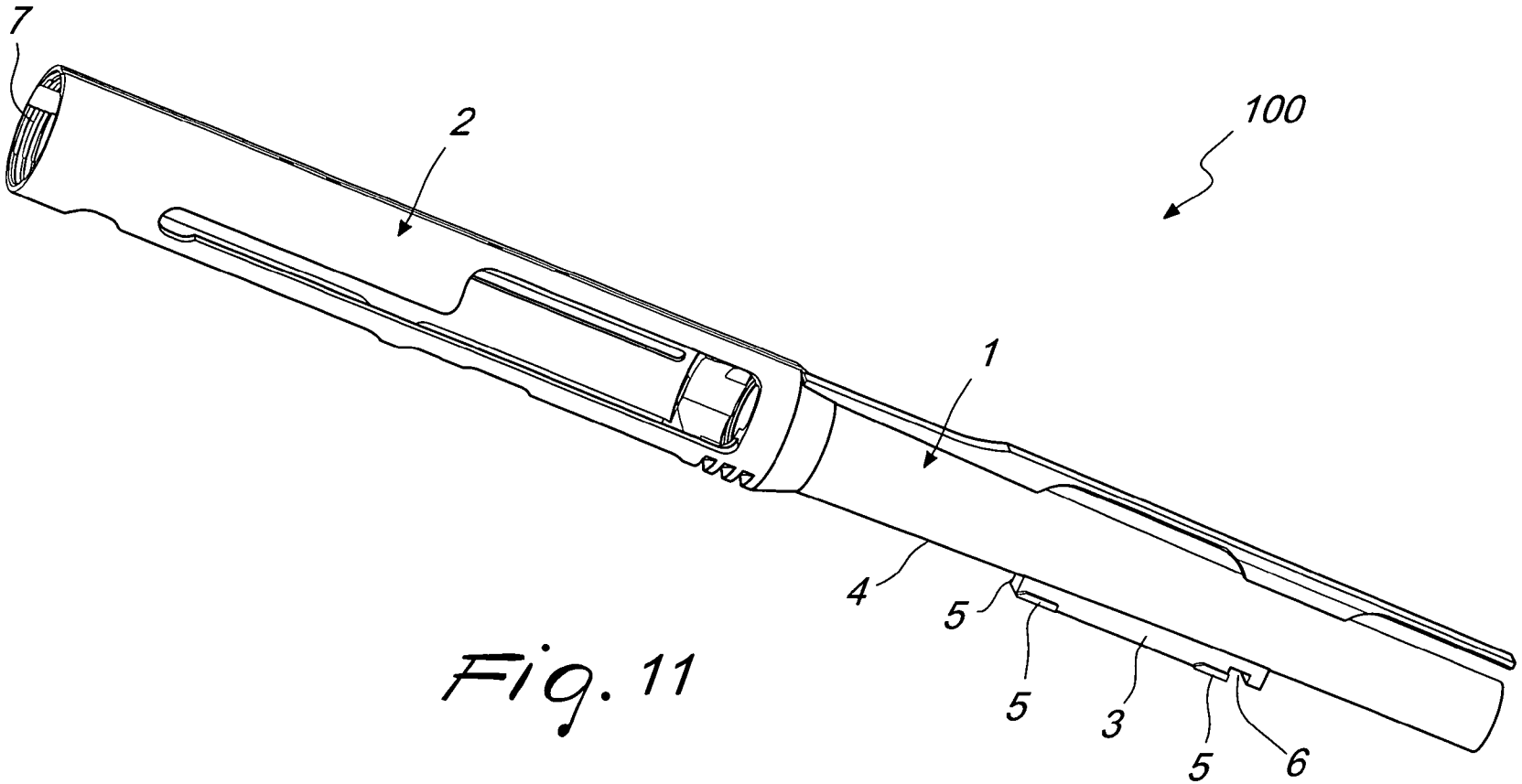
FIG. 11 is a perspective view of the supporting module of the weapon according to the present invention, constituted by the barrel and by its sheath or barrel extension.

With particular reference to FIG. 11, the supporting module 100, according to the present invention, formed by the barrel 1 and by the barrel extension 2, has a block 3 which is welded to the barrel 1.

The block 3 has a flat and elongated shape, which adheres snugly to the outer profile 4 of the barrel 1, so that it can be obtained both by welding and monolithically by machining the material of the barrel 1 itself.

The block 3, which is welded to or formed from the barrel 1, is provided on both sides with two guides 5 and with a front slot 6, which as will become better apparent hereinafter are used to keep the modular portable weapon system assembled without requiring mutually screwed components.

The sheath or barrel extension 2 has such a length as to contain the entire locking and recocking module with swivel breech-lock and rotating locking head 101, and is provided at the rear with a coupling seat, constituted in the specific case by threaded sectors 7, for rapid engagement of the stock or handle module 102, which is provided with a corresponding quick engagement system.

Figure 2:
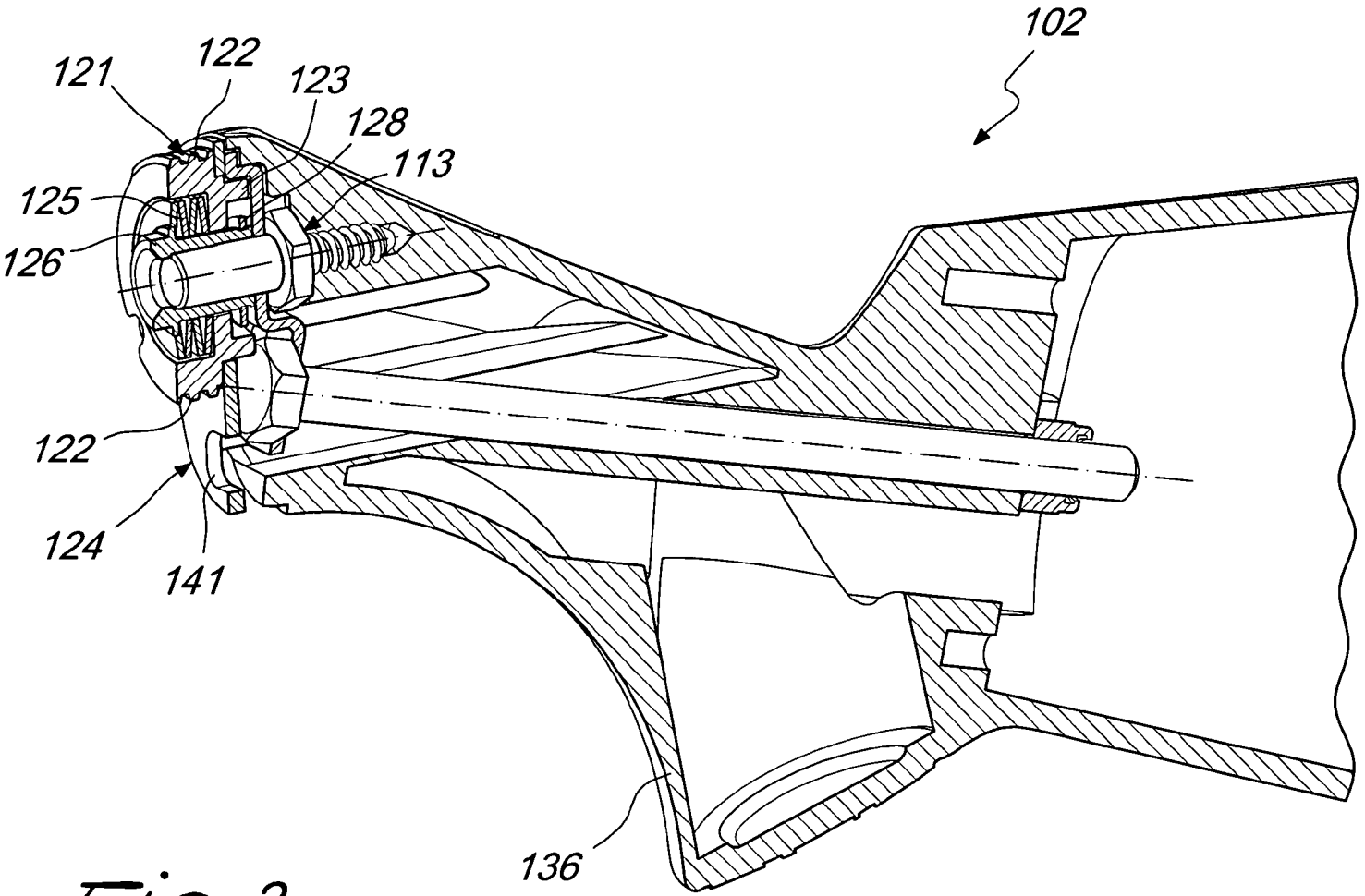
FIG. 2 is a sectional perspective view of the stock module of the weapon according to the present invention.

As can be seen in FIG. 2, the quick engagement system of the stock or handle module 102 essentially includes an annular main body 121 which has threaded sectors 122, a cylindrical stem 123 for centering on the stock, and an internal seat for Belleville springs 125.

A fastening nut 126 is provided with a shank which passes internally through both the Belleville springs 125 and the annular main body 121 to ensure the mounting of the Belleville springs 125 on the annular main body 121 by virtue of a snap ring 128 which engages on a seat thereof which is formed at the rear end of the shank of the fastening nut 126.

The entire assembled annular main body 121 can thus be screwed freely, at least in the initial step, onto a threaded stem of a tension member 113 which is mounted on the stock.

The quick coupling also offers the possibility to provide the stock or handle 102 with a given drop and cast with respect to the aiming line of the weapon by means of an adjustment member constituted by an abutment plate 124.

The thickness of the plate 124 is conveniently determined in relation to the drop and cast that the stock must have with respect to the aiming line of the weapon.

The thickness of the plate 124 is therefore different both when considered on its vertical axis and when considered on its horizontal axis.

The stock module 102 is mounted to the supporting module on the barrel extension 2 of the module.

In order to assemble the stock module 102, complete with quick coupling, it is sufficient to arrange the stock module adjacent to the sheath or barrel extension 2, which has, as the rear, inside it, the threaded sectors 7, which are suitable to screw onto the corresponding threaded sectors 122 provided on the annular main body 121.

Screwing occurs rapidly, inserting the entire annular main body 121 inside the barrel extension 2, taking care, during insertion, to align its threaded sectors 122 with recesses formed inside the barrel extension 2, the alignment being easily obtained by keeping, for example, the pistol grip of the stock 136 in a transverse position with respect to the vertical axis of the weapon, i.e., at 90°, and by then screwing together the threaded sectors 122 of the annular main body 121 with the respective threaded sectors 7 of the sheath or barrel extension 2, with a rotary motion of the stock which has a rotation end position determined automatically by the contact of a stroke limiter.

The stock module 102 complete with quick coupling is correctly mounted on the weapon when, after rotation is completed, the pistol grip of the stock 136 is aligned with the vertical axis of the weapon.

The drop and cast of the stock 102, provided by the plate 124, are determined when the entire stock module 102 is mounted on the supporting module 100.

The quick coupling is assembled with the tension member 113 screwed onto the stock.

When the stock module 102 is screwed onto the supporting module 100, the compression of the Belleville springs 125 is such as to ensure perfect adhesion between the stock module 102, the plate 124 and the annular main body 121 of the quick coupling.

With the stock module 102 disassembled from the weapon, it is possible to unscrew the nut 126 in order to disassemble the annular main body 121 and replace, or simply overturn the same plate 124 and screw the nut 106 back to obtain a different drop or cast of the stock when it is mounted on the weapon again.

Figure 3:
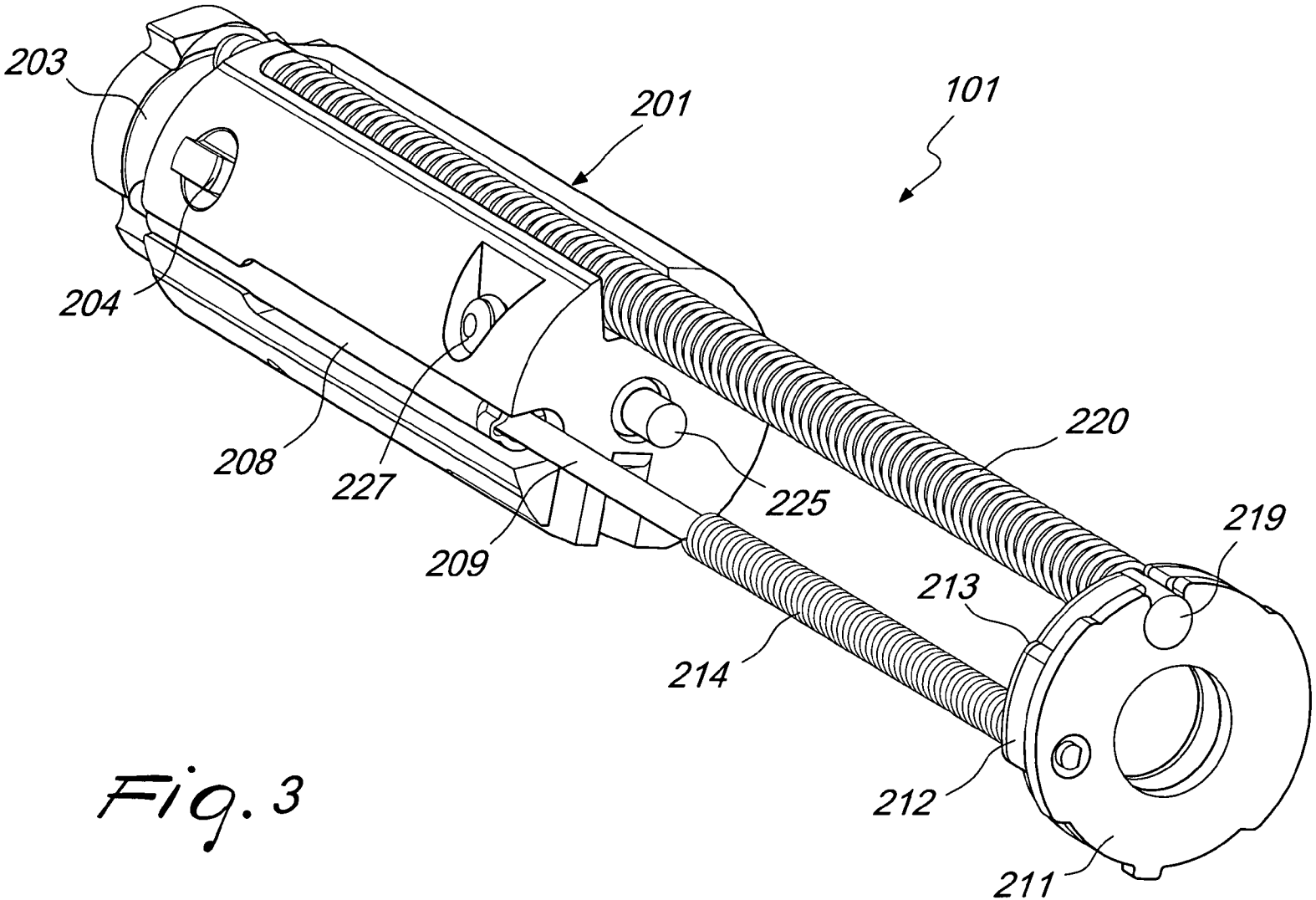
FIG. 3 is a perspective view of the locking and recocking module with swivel breech-lock and rotating locking head.

FIG. 3 is a view of the locking and recocking module with swivel breech-lock and rotating locking head 101, which is constituted by a single body which is completely accommodated within the sheath or barrel extension 2 and has a locking means, for locking the firing chamber of the weapon, an opening means, a case ejection means, and a recocking means with locking return.

The locking and recocking module with swivel breech-lock and rotating locking head 101 comprises a swivel breech-lock 201, in which a breech-lock recoil spring is inserted and in which a rotating locking head 203 is mounted.

The rotating locking head 203 is jointly connected to the breech-lock 201 by means of a head rotation pivot 204, which in order to concentrate the entire movable mass which is needed for the operation of the weapon on the breech-lock is jointly connected to the breech-lock and engages a helical cam, not shown in the figure, which is provided on the cylindrical shank of the locking head.

The entire mass required for inertial operation of the weapon is concentrated exclusively on the swivel breech-lock 201 which, being accommodated within the sheath or barrel extension of the weapon, is the member onto which the components of the system are assembled.

The rotating locking head 203 provides the locking and opening of the firing chamber of the weapon by a rotary motion determined by the helical cam, which is provided on its stem, with the contribution of helical inclined planes. The inclined planes mutually converge and are provided both on the rotating locking head and on the swivel breech-lock. The inclined planes prevent the possible bouncing of the swivel breech-lock when, during the locking action, it abuts against the spring of the inertial system.

The module 101 includes an ejector module 208, which is inserted within a longitudinal seat formed on the swivel breech-lock.

A guiding pin 209 is inserted in the ejector body 208 and is fastened to a spring guide pin anchoring plate 211, on which a damper 212, for cushioning the impact of the swivel breech-lock on its stroke limiter, a breech-lock abutment plate 213, on which the stroke of the swivel breech-lock indeed ends during opening, and an ejector spring 214 are mounted sequentially.

The position of the ejector 208 on the locking and recocking module with swivel breech-lock and rotating locking head is such as to allow the ejector spring 214 to also operate as an auxiliary recoil spring, during the first step of the locking action, and allow the ejector spring guide pin 209 to guide laterally the cartridge during its lifting and insertion into the firing chamber of the weapon.

A recoil spring guide pin 219 is inserted, through a hole, on the swivel breech-lock 201 and a recoil spring 220 is mounted at the rear on a suitable groove, and allows the swivel breech-lock 201 to return to the closed position.

A firing pin 225 is mounted on the swivel breech-lock 201 and, inserted in the corresponding spring, which is not shown in the figure, passes through the rotating locking head 203, the head rotation pivot 204 and the breech-lock and is rigidly coupled to the latter by means of a retention pin 227.

Figure 4:
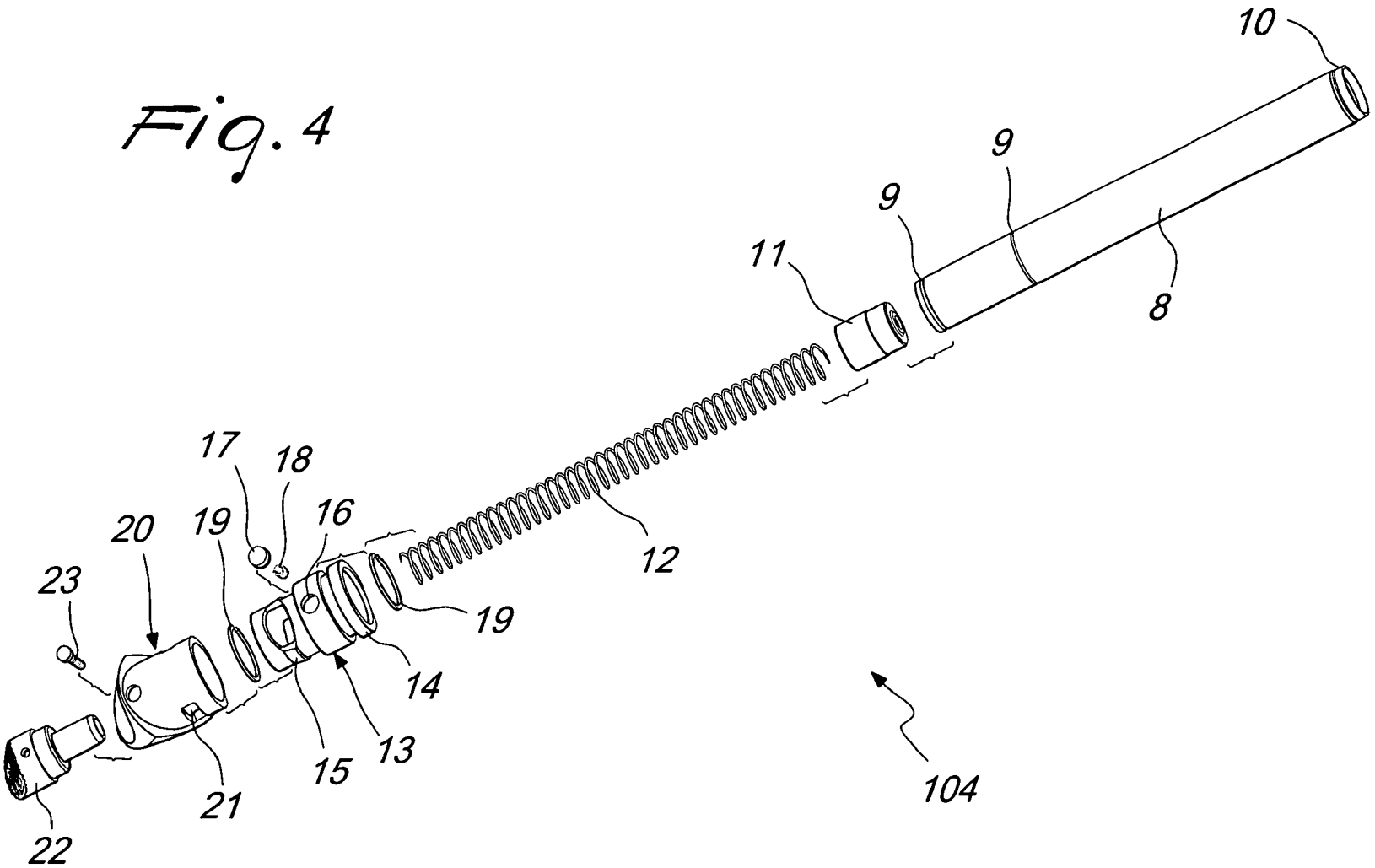
FIG. 4 is an exploded perspective view of the components of the magazine module of the weapon.
Figure 5:
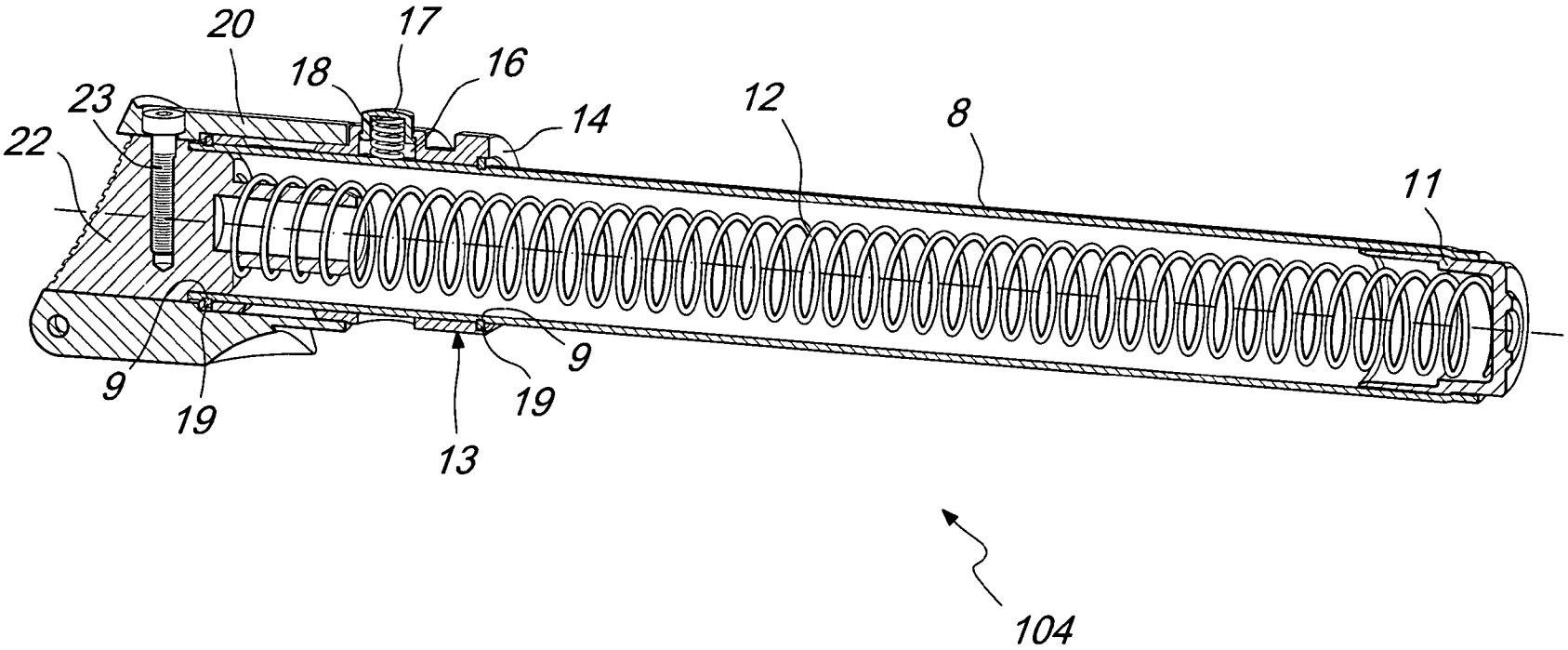
FIG. 5 is a sectional enlarged-scale perspective view of the magazine module in the assembled condition.

As show more clearly in FIGS. 4 and 5, the magazine module 104 comprises a tubular magazine 8, which has, at the front, seats 9 for snap rings and, in its rear end, a choked portion 10, which is suitable to stop a cartridge presser 11 which is inserted therein so as to provide a retainer for a magazine spring 12 without thereby preventing the insertion of the cartridges to load the weapon.

A flange 13 provided with an annular portion 14, with two toothed sectors 15 and with a seat 16 for a stop button 17 with a corresponding return spring 18, is mounted onto the front part of the tubular magazine 8.

A rod plug 20 is mounted on the flange 13, which is fixed to the tubular magazine 8 by virtue of the snap rings 19, through slots 21 which engage the toothed sectors 15 of the flange 13.

In order to allow the internal cleaning of the tubular magazine 8, there is a magazine plug 22 which is inserted within the rod plug 20 and is locked by a screw 23.

The entire magazine module is thus assembled, as can be seen in FIG. 5, independently of the other components of the modular weapon, according to the present invention, without becoming in itself a supporting member for the complete assembly of the weapon, as instead normally occurs in prior art weapons.

As is evident from FIG. 5, by providing tubular magazines 8 of different length, a range of tubular magazines containing a different number of cartridges is made easily available to users.

Figure 6:
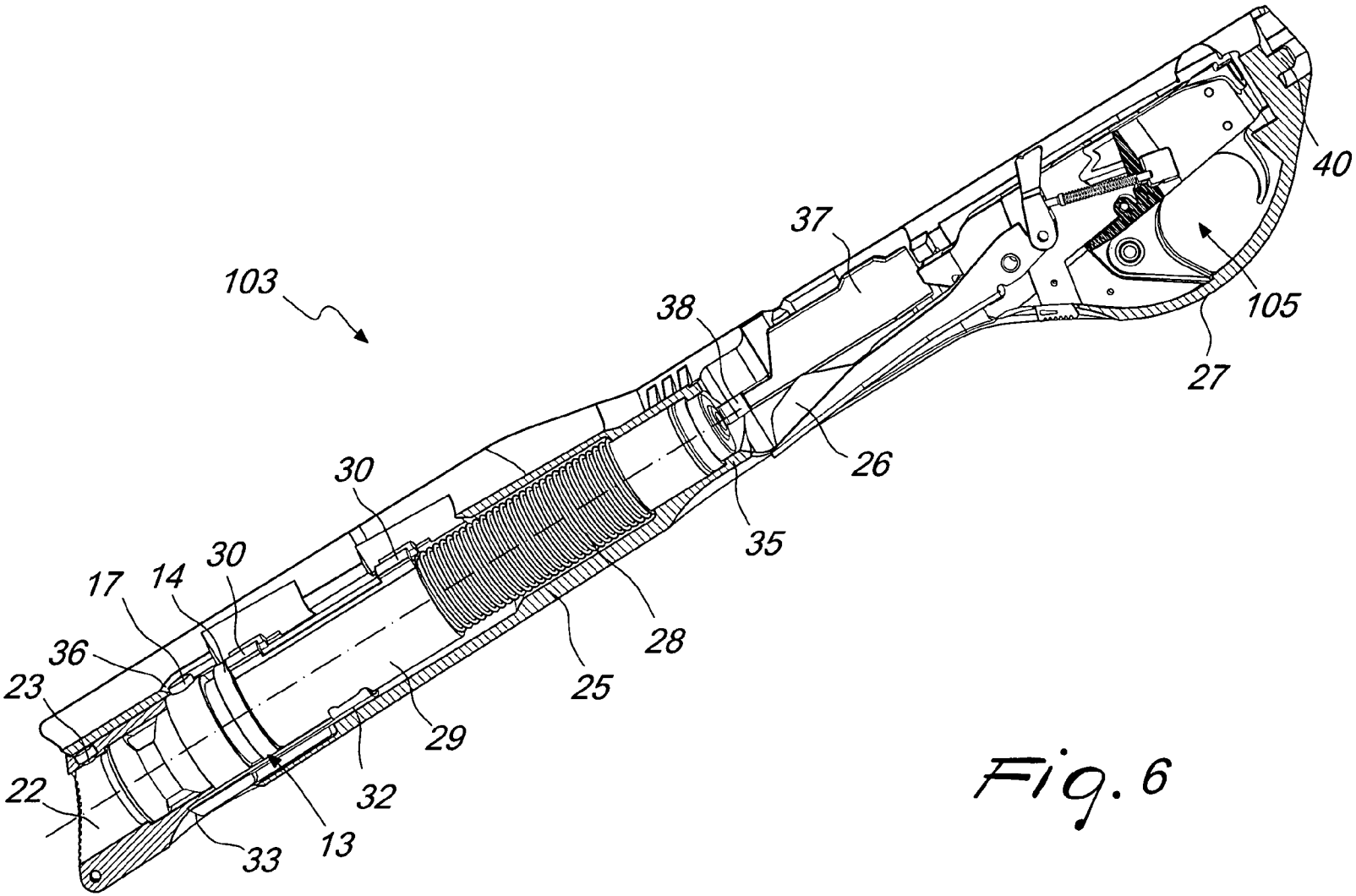
FIG. 6 is a sectional perspective view of the containment module, complete with the magazine module and with all the other internal components that allow its engagement with the supporting module of the weapon.

The entire magazine tube module 104 is accommodated within the containment module 103 without however being an integral part thereof, as shown more clearly in FIG. 6.

The containment module 103 can be made of plastic material, by molding, without requiring metallic inserts or other reinforcement members.

The containment module 103 comprises a portion 25 which acts as a forestock to grip the weapon with one's hand, a portion 26 which acts as a receiver for a containing the firing mechanism of the weapon and the system for actuating the cartridges that exit from the magazine, and a portion 27 which acts as a trigger plate, as a trigger protection member.

A spring 28 is inserted within the forestock portion 25 and is adapted to draw an anchoring sleeve 29 which has claws 30 which engage the guides 5 of the block 3 of the barrel 1, constituting the system for engaging the containment module 103 with the supporting module 100.

A slider 32 is engaged on a seat 31 of the anchoring sleeve 29 and is pushed with one's hand on its front plane 33 in order to retract the sleeve 29 and compress the spring 28.

The fully assembled magazine tube module 104 is inserted in the sleeve 29 and the corresponding return spring 28 until the throttled part 10 of the tubular magazine 8 abuts against a stop tooth 35 of the containment module 103.

In this position, the stop button 17 of the magazine module 104 interferes with a wall 36 of the containment module 103, preventing the magazine module 104 from being extracted inadvertently.

This type of preassembly ensures that the magazine module does not fall off inadvertently. After completing the full assembly of the weapon, the magazine module itself is in fact rigidly fastened to the weapon although it is not provided with threads which bind it rigidly with other components.

The containment module 103 comprises a cartridge retention lever 37, which, by means of a front part 38 thereof, stops the cartridges within the magazine module 104 when the weapon is loaded.

The portion of the receiver 26 of the containment module 103 accommodates the entire firing and cartridge feed mechanism, generally designated by the reference numeral 105, which is not described here since it is per se known.

Figure 7:
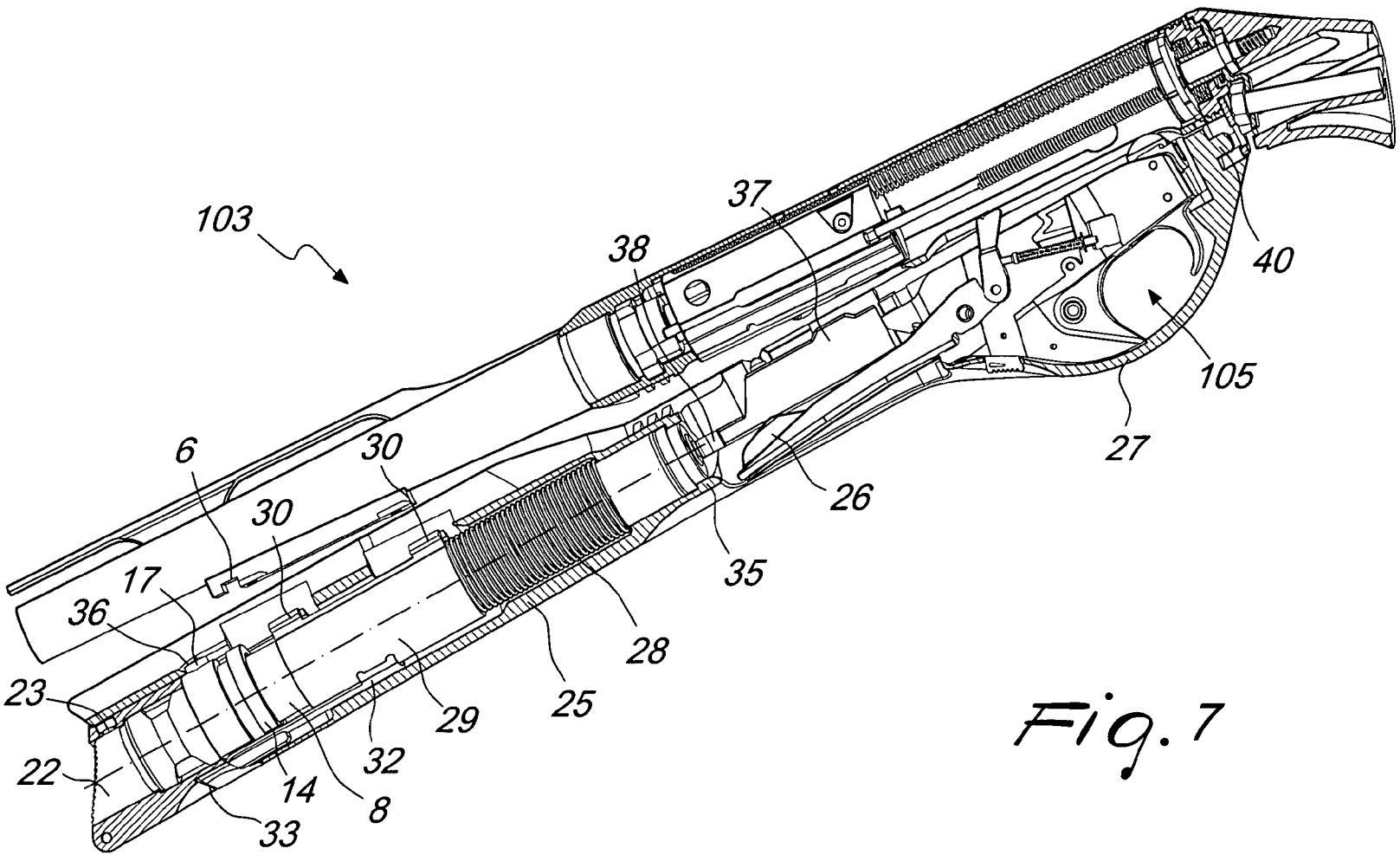
FIG. 7 is a sectional perspective view of the system during a step of assembly.

The complete assembly of the weapon occurs, as shown schematically in FIG. 7, extremely rapidly, simply by mutually engaging the various modules that compose the weapon without requiring the additional members needed in traditional weapons during final assembly of the weapon, such as for example the barrel fixing cap, the guide rod, et cetera.

Once the supporting module 100 is already complete with a locking and recocking assembly with swivel breech-lock 101 mounted inside it and retained thereat by the stock module 102, engaged on the rear part of the sheath or barrel extension 2, it is sufficient to take the containment module 103, complete with all the components described above, and arrange a tab 40 thereof adjacent to the slot 141 formed in the plate 124 which belongs to the stock module until they are engaged in each other.

Figure 8:
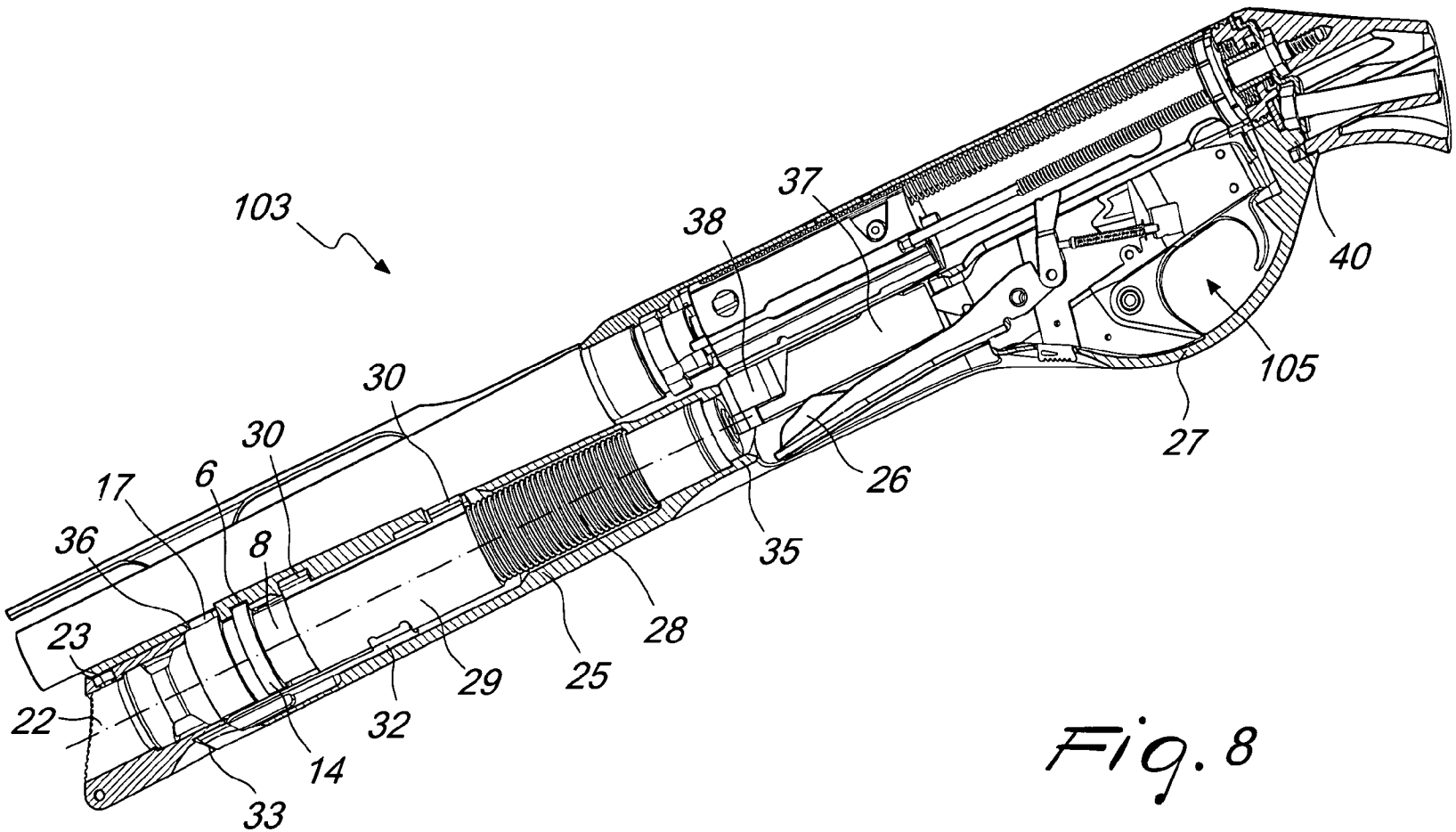
FIG. 8 is a sectional perspective view of the fully assembled system.

By then pressing with one finger the surface 33 of the lever 32, the sleeve 29 is retracted and, by resting against the spring 28, compresses it, moving into such a position as to be able to align the entire containment module 103 on an axis which is substantially parallel to the barrel axis 1 or supporting module 100, keeping the claws 30 of the sleeve 29 in a retracted position with respect to the claws 5 provided on the block 3 which is welded or formed from the barrel 1, as shown more clearly in FIG. 8.

As shown more clearly in FIG. 6, in this position it can be seen that the annular portion 14 of the flange 13, which belongs to the magazine module 102, engages in the front slot 6 of the block 3, which is welded or obtained from the barrel 1, providing a coupling which is capable of withstanding all the stresses to which the magazine module is subjected, although the latter is not screwed onto other weapon components.

It can be seen that the supporting module 100 also acts as a support for the cartridge retention lever 37 by virtue of the contact of its plane 43 with the respective plane 44 of the sheath or barrel extension.

In this manner, when the locking and recocking module with swivel breech-lock remains in the open position, to warn that the weapon is empty, all the stresses produced by its recovery spring against the cartridge retention lever are transmitted, according to the present invention, directly to the sheath or barrel extension 2 of the supporting module of the system and not to the containment module 103.

This simple solution, too, helps to eliminate the receiver that is required in prior art weapons and performs the function described above, facilitating the provision of the containment module 103, which is one of the most important innovations of the modular portable weapon system according to the invention.

Figure 9:
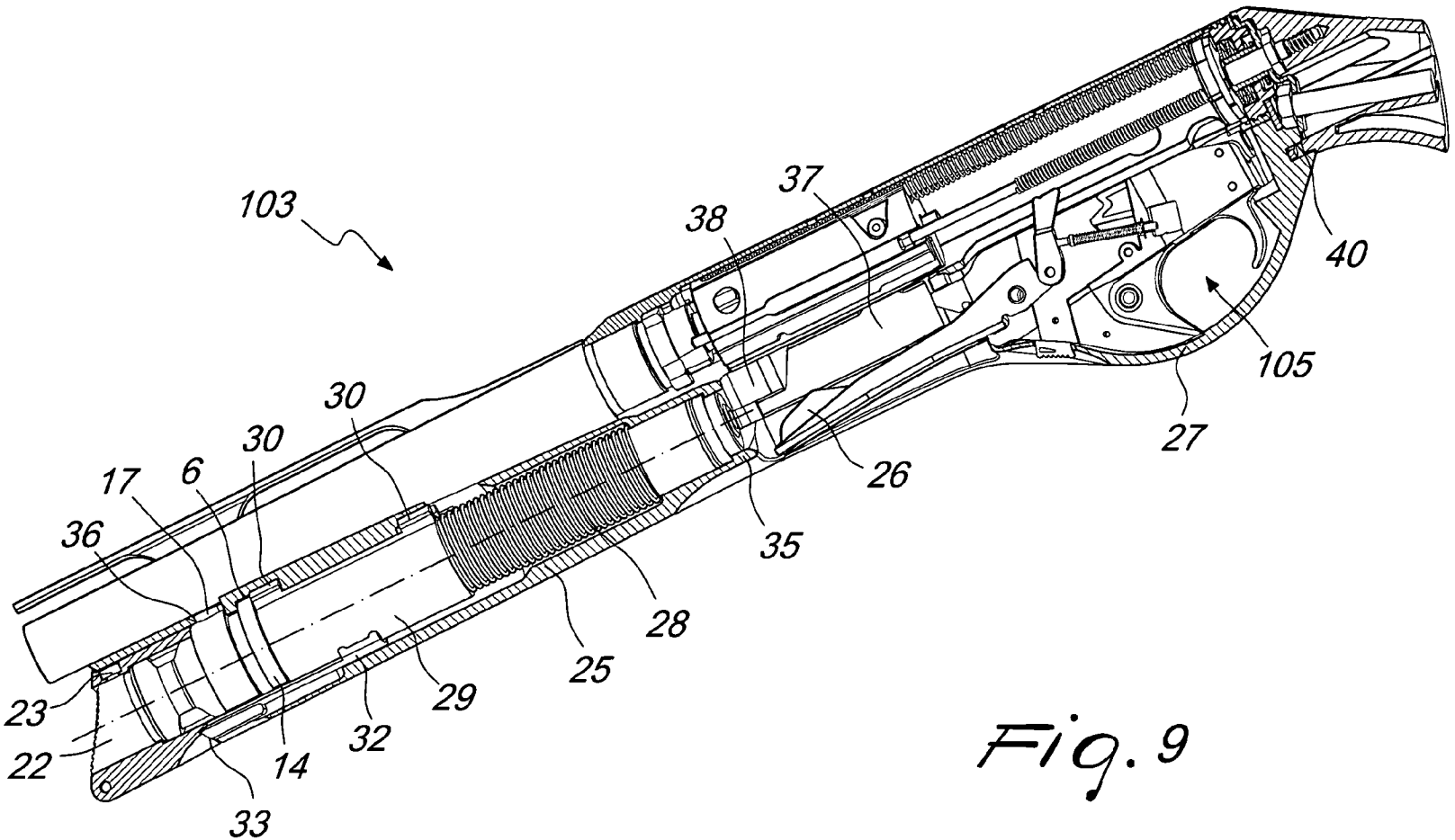
FIG. 9 is a perspective view, similar to the preceding figure, of the assembled and locked system.

At this point, it is simply sufficient to remove the pressure of the finger against the plane 33 of the lever 32 to obtain, as shown more clearly in FIG. 9, a forward movement of the sleeve 29, under the thrust of the return spring 28, such as to engage its claws 30 on the respective claws 5 of the block 3, which is welded or obtained on the barrel 1.

Figure 10:
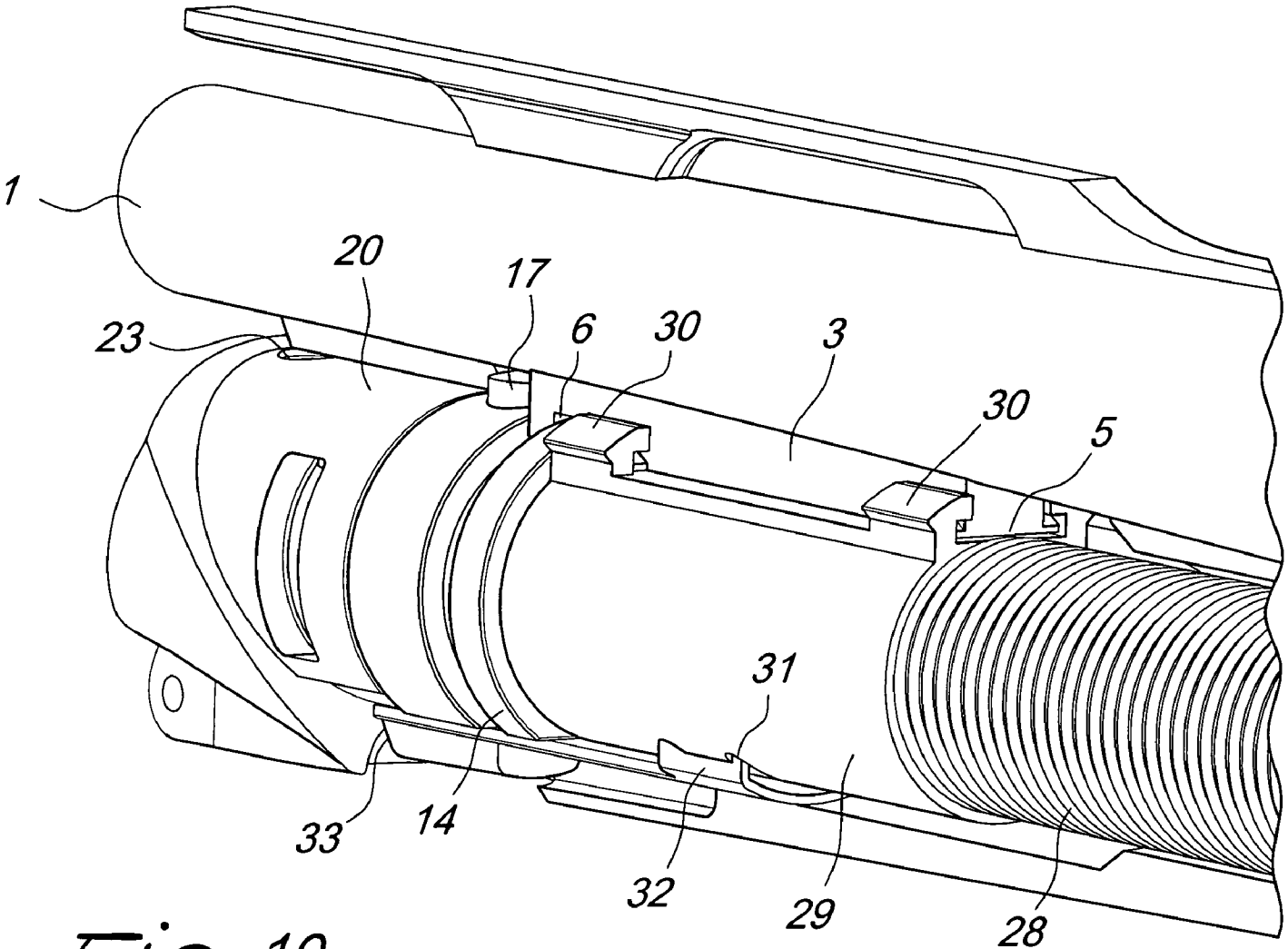
FIG. 10 is an enlarged-scale perspective view which shows in detail the assembly claw provided respectively on the sleeve and on the sheath or barrel extension, in the completed assembly position.

FIG. 10 is a detail view of the sleeve 29 with its claws 30 engaged on the respective guides 5 of the block 3 welded or provided from the barrel 1.

With this simple longitudinal engagement, the assembly of the modular weapon according to the present invention is completed.

The modular weapon comprises a single supporting module, which is constituted by the barrel and by the sheath or barrel extension, to which it is possible to apply the other modules without using additional members.

The stresses produced by the firing of the cartridge during use of the weapon are discharged mainly onto the supporting module.

All the components of the weapon are part of a modular system with mutually independent modules, each capable of performing its own function and all manually engageable with each other, without requiring tools for the final assembly of the weapon, allowing the user also to choose, among the commercially available modules, supporting modules with barrels of different lengths and different sight type, stock modules with different types of grip, tubular magazine modules which contain mutually different numbers of cartridges, the one that complies best with his requirements.

In practice it has been found that the invention achieves the intended aim and objects, a modular portable weapon having been provided in which the main functions are assigned to various essential parts which are provided in such a manner that they can be considered as true independent modules, to be mutually composed in order to easily obtain a weapon which is configured according to the various requirements.

The modular portable weapon according to the present invention in fact arranges in an entirely innovative manner the main components that are traditionally present in a portable weapon, such as a smoothbore or rifled-bore rifle, attributing even different functions to these components.

The modular portable weapon according to the present invention is constructively simple and has a reduced number of components with respect to traditional weapons.

The supporting module, formed by the barrel with its sheath or barrel extension, is provided with a locking and recocking module with swivel breech-lock and rotating locking head, which is mounted within the sheath or barrel extension itself and is capable of performing all the functions for locking, opening, case ejection and recocking with return to locking, which are required for correct operation of the weapon. In this manner, considerable advantages have been achieved in terms of efficiency, simplicity, functionality of the system, achieving a reduction in the number of components by virtue of the provision of an innovative module in which all the moving parts for locking and opening the firing chamber of the weapon, the mass of the swivel breech-lock, the recoil spring, the breech-lock recovery spring, the ejector and the corresponding spring are contained within the sheath or barrel extension and are not arranged in a dissociated manner as in hitherto known weapons.

The module that constitutes the stock of the weapon is mounted on the same supporting module formed by the barrel provided with a sheath or barrel extension by means of a quick coupling which has a drop and cast which can be obtained automatically upon its engagement on the sheath. In this manner, the availability of various modules with various types of stock, such as pistol grip stocks, pistol handle stocks, telescopic stocks, et cetera, ensures the possibility to obtain easily a weapon which is configured according to the various stock mounting requirements.

It is also possible to engage another modular component of the weapon on the supporting module formed by the barrel provided with the sheath or barrel extension. Such other module is constituted by a tubular magazine which, without requiring disassembly of its internal components, can be easily separated from the weapon by virtue of the complete lack of the threads that are normally present in traditional weapons. In this manner, the availability of tubular magazines of different lengths ensures the possibility to easily have a weapon with a tubular magazine which contains a larger or smaller number of cartridges depending on the various requirements of use.

The supporting module according to the present invention has allowed to avoid the need to have, as in traditional weapons, members such as the frame or receiver made of steel or light alloy, the magazine tube rigidly coupled thereto and the locking cap of the entire receiver-barrel-forestock system of the weapon, and it has been possible to provide monolithically, by molding plastic material without requiring metallic inserts embedded internally or other reinforcement members, a new component, the containment module, which has the triple function of a forestock for gripping the weapon with one's hand, of a receiver as a member for containing the firing mechanism of the weapon, and of the exit and lifting actuation system of the cartridges of the magazine and of a trigger plate as a trigger protection member.

This new component, the containment module, is simply engaged with the supporting module formed by the barrel with its sheath or barrel extension, without requiring screws or threaded caps but exclusively by means of the claws provided on a sliding sleeve which is mounted at the front inside it and through an interlocking on a plate of the stock module which is rigidly coupled to the rear part of the sheath or barrel extension.

The present invention provides a portable weapon which allows to consider the weapon no longer as a set of components which are generally assembled into subassemblies which in turn are assembled until two essential parts of the weapon are obtained, such as the barrel assembly and the receiver assembly, but as a set of independent modular parts, each capable of performing a function of its own, and all of which can be assembled together without requiring tools.

The modular portable weapon according to the present invention therefore allows the end user to compose the weapon by choosing for example a type of barrel, stock or tubular magazine among the alternatives provided commercially, with the characteristics that are best suited to his requirements.

This application claims the priority of Italian Patent Application No. MI2007A001473, filed on Jul. 20, 2007, the subject matter of which is incorporated herein by reference.

What is claimed is:

1. A modular portable weapon comprising a supporting module, including a barrel of the weapon and a sheath or barrel extension extending rearwardly from and coaxially with said barrel, and one or more modules which are functionally mutually independent and are associated with said supporting module, said one or more modules including a locking and recocking module insertable into said sheath or barrel extension for containment therein, a stock or handle module directly connectable to a rear end of said sheath or barrel extension, a containment module connectable directly to said barrel at a location forward of said sheath or barrel extension, a magazine module, and a cartridge lifting and firing mechanism module, said locking and recocking module including a breech-lock and a locking head, wherein said cartridge lifting and firing mechanism module is received substantially entirely in a receiver portion of the containment module.

2. The modular portable weapon according to claim 1, wherein said locking and recocking module is configured to perform the functions of locking and opening a firing chamber, ejecting a case and recocking with return to locking, required for operation of the weapon.

3. The modular portable weapon according to claim 1, wherein said stock or handle module is connectable to said sheath or barrel extension by quick coupling elements of said stock or handle module and said sheath or barrel extension.

4. The modular portable weapon according to claim 1, wherein said containment module is configured to contain said magazine module and said cartridge lifting and firing mechanism module.

5. The modular portable weapon according to claim 2, wherein said barrel is screwed onto said sheath or barrel extension.

6. The modular portable weapon according to claim 5, wherein said containment module is removably connectable to said barrel without the use of tools via a block on an underside of said barrel.

7. A modular portable weapon comprising a supporting module including a barrel of the weapon and a sheath or barrel extension extending rearwardly from and coaxially with said barrel, and a plurality of modules which are functionally mutually independent and individually interchangeable and which are associated with said supporting module, said modules including a locking and recocking module, a stock or handle module, a containment module, a magazine module, and a cartridge lifting and firing mechanism module, said locking and recocking module including a breech-lock and a locking head, said locking and recocking module being insertable into said sheath or barrel extension for containment therein, said stock or handle module being directly connectable to a rear end of said sheath or barrel extension, and said containment module being connectable directly to said barrel at a location forward of said sheath or barrel extension, said locking and recocking module being configured to perform the functions of locking and opening the firing chamber, ejecting the case and recocking with return to locking, required for operation of the weapon, said barrel being screwed onto said sheath or barrel extension, said containment module being removably connectable to said barrel without the use of tools via a block on an underside of said barrel, wherein said block has a flat and elongated shape which adheres tightly to an outer profile of said barrel, so that said block is produceable by a process taken from the group consisting of welding and monolithically machining the material of said barrel.

8. The modular portable weapon according to claim 7, wherein said block is provided on both sides with two guides and with a front slot, which are suitable to engage claws of said containment module, constituting a system for engaging the containment module with the supporting module.

9. The modular portable weapon according to claim 3, wherein said stock or handle module is associated with said supporting module by a member for adjusting the drop and cast of the stock.

10. A modular portable weapon comprising:

a supporting module, constituted by a barrel of the weapon and a sheath or barrel extension extending rearwardly from and coaxially with said barrel;

a locking and recocking module insertable into said sheath or barrel extension; and one or more additional modules which are functionally independent of one another and of said locking and recocking module and are associated with said supporting module, said one or more modules including a stock or handle module, a containment module, a magazine module, and a cartridge lifting and firing mechanism module, said locking and recocking module including a breech-lock and a locking head, said locking and recocking module further including a recoil spring, said breech-lock being a swivel breech-lock constituted by a single body which is accommodated completely within said sheath or barrel extension, said recoil spring being a breech-lock recoil spring inserted in said swivel breech-lock and said locking head being a rotating locking head fitted therein, said rotating locking head being rigidly coupled to said breech-lock by a head rotation pivot which is rigidly coupled to said breech-lock and engages a helical cam formed on a cylindrical shank of said locking head, and the entire mass required for the inertial operation of the weapon being concentrated exclusively on said swivel breech-lock.

11. The portable modular weapon according to claim 10, wherein said locking and recocking module comprises an ejector body which is inserted within a longitudinal seat formed in said swivel breech-lock; a guiding pin is inserted within the ejector body and is fixed to a spring guiding pin anchoring plate, on which a damper, for cushioning the impact of the swivel breech-lock on its stroke limiter, a breech-lock abutment plate, on which the stroke of the swivel breech-lock ends during opening, and an ejector spring are mounted sequentially; the position of said ejector on the locking and recocking module with swivel breech-lock and rotating locking head is such as to allow the ejector spring to operate also as an auxiliary recovery spring, during the first step of the locking action, and allow the ejector spring guiding pin to guide the cartridge laterally during its lifting an insertion in the firing chamber of the weapon; furthermore, a recovery spring guiding pin is inserted in the swivel breech-lock through a hole and a recovery spring is mounted at the rear on a recess, said spring allowing the swivel breech-lock to return to the closed position; a firing pin is furthermore mounted on the swivel breech-lock and, when inserted in a corresponding spring, passes through the rotating locking head, the head rotation pivot, and the breech-lock itself, and is rigidly coupled to the latter by a retention pin.

12. A modular portable weapon comprising a supporting module including a barrel of the weapon and a sheath or barrel extension extending rearwardly from and coaxially with said barrel, and a plurality of modules which are functionally mutually independent and individually interchangeable and which are associated with said supporting module, said modules including a locking and recocking module, a stock or handle module, a containment module, a magazine module, and a cartridge lifting and firing mechanism module, said locking and recocking module including a breech-lock and a locking head, said locking and recocking module being insertable into said sheath or barrel extension for containment therein, said stock or handle module being directly connectable to a rear end of said sheath or barrel extension, and said containment module being connectable directly to said barrel at a location forward of said sheath or barrel extension, wherein said containment module is configured to contain said magazine module and said cartridge lifting and firing mechanism module, wherein said magazine module comprises a tubular magazine which has, at a front side, seats for snap rings and, at a rear end, a throttled portion which is suitable to stop a cartridge presser which is inserted inside said tubular magazine so as to provide a retainer for a magazine spring without preventing the insertion of the cartridges to load the weapon; a flange provided with an annular member is mounted on a front part of said tubular magazine and has two toothed sectors and a seat for a stop button with a corresponding return spring; a rod plug is fitted to said flange, which is fixed to the tubular magazine by snap rings, through slots which engage the toothed sectors of the flange; and a magazine plug which is inserted in the rod plug and is locked by means of a screw allows internal cleaning of the tubular magazine.

13. A modular portable weapon comprising a supporting module including a barrel of the weapon and a sheath or barrel extension extending rearwardly from and coaxially with said barrel, and a plurality of modules which are functionally mutually independent and individually interchangeable and which are associated with said supporting module, said modules including a locking and recocking module, a stock or handle module, a containment module, a magazine module, and a cartridge lifting and firing mechanism module, said locking and recocking module including a breech-lock and a locking head, said locking and recocking module being insertable into said sheath or barrel extension for containment therein, said stock or handle module being directly connectable to a rear end of said sheath or barrel extension, and said containment module being connectable directly to said barrel at a location forward of said sheath or barrel extension, wherein said containment module is configured to contain said magazine module and said cartridge lifting and firing mechanism module, wherein said containment module is made of plastic material, by molding, without metallic inserts or other reinforcement members.

14. The modular portable weapon according to claim 4, wherein said containment module comprises a portion which acts as a forestock for gripping the weapon with one's hand, a portion which acts as said receiver portion for containing at least a portion of said cartridge lifting and firing mechanism module and an actuation system of cartridges that exit from said magazine, and a portion which acts as a trigger plate, as a protective member for the trigger.

15. A modular portable weapon comprising a supporting module including a barrel of the weapon and a sheath or barrel extension extending rearwardly from and coaxially with said barrel, and a plurality of modules which are functionally mutually independent and individually interchangeable and which are associated with said supporting module, said modules including a locking and recocking module, a stock or handle module, a containment module, a magazine module, and a cartridge lifting and firing mechanism module, said locking and recocking module including a breech-lock and a locking head, said locking and recocking module being insertable into said sheath or barrel extension for containment therein, said stock or handle module being directly connectable to a rear end of said sheath or barrel extension, and said containment module being connectable directly to said barrel at a location forward of said sheath or barrel extension, wherein said containment module is configured to contain said magazine module and said cartridge lifting and firing mechanism module, wherein said containment module comprises a portion which acts as a forestock for gripping the weapon with one's hand, a portion which acts as a receiver for containing at least a portion of said cartridge lifting and firing mechanism module and an actuation system of cartridges that exit from said magazine, and a portion which acts as a trigger plate, as a protective member for the trigger, wherein a block is provided on said barrel for coupling said containment module to said barrel, said block having a flat and elongated shape provided on opposing sides with guides, a spring being inserted in said forestock drawing an anchoring sleeve which has claws suitable to engage said guides of said block of the barrel, said block, said spring and said sleeve constituting the system for engaging the containment module with the supporting module.

16. The modular portable weapon according to claim 15, wherein a slider is engaged on a seat of said anchoring sleeve and is suitable to be pushed manually on a front plane thereof in order to retract said sleeve and compress said spring.

17. The modular portable weapon according to claim 16, wherein said magazine module is inserted fully assembled within said sleeve and said spring until a throttled part of the tubular magazine abuts against a stop tooth of the containment module; and in this position, a stop button of the magazine module interferes with a wall of the containment module, preventing said magazine module from disengaging inadvertently.

18. The modular portable weapon according to claim 4, wherein said containment module comprises a cartridge retention lever which, with a front part thereof, stops the cartridges within the magazine module when the weapon is loaded.

19. The modular portable weapon according to claim 1, wherein said supporting module and said one or more modules are mutually engageable without requiring additional members and without the aid of tools.

20. A modular portable weapon comprising a supporting module including a barrel of the weapon and a sheath or barrel extension extending rearwardly from and coaxially with said barrel, and a plurality of modules which are functionally mutually independent and individually interchangeable and which are associated with said supporting module, said modules including a locking and recocking module, a stock or handle module, a containment module, a magazine module, and a cartridge lifting and firing mechanism module, said locking and recocking module including a breech-lock and a locking head, said locking and recocking module being insertable into said sheath or barrel extension for containment therein, said stock or handle module being directly connectable to a rear end of said sheath or barrel extension, and said containment module being connectable directly to said barrel at a location forward of said sheath or barrel extension, said locking and recocking module being configured to perform the functions of locking and opening the firing chamber, ejecting the case and recocking with return to locking, required for operation of the weapon, said barrel being screwed onto said sheath or barrel extension, said containment module being removably connectable to said barrel without the use of tools via a block on an underside of said barrel, wherein said magazine module comprises a tubular magazine and wherein a flange provided with an annular member is mounted on a front part of said tubular magazine, said block of said barrel comprising a front slot in which an annular portion of said flange of said magazine module engages.

21. A method for using a modular portable weapon comprising:

assembling a plurality of functional modules to a supporting module constituted by the barrel of the weapon and by a sheath or barrel extension rearward of said barrel, said modules being functionally mutually independent, said modules including a locking and recocking module, a stock or handle module, a containment module, a magazine module, and a cartridge lifting and firing mechanism module, said locking and recocking module including a breech-lock and a locking head, wherein the assembling of said functional modules to said supporting module includes connecting said stock or handle module directly to a rear end of said sheath or barrel extension, inserting said locking and recocking module into said sheath or barrel extension, and connecting said containment module directly to said barrel at a location forward of said sheath or barrel extension;

at least partially disassembling the assembled weapon, the disassembling including separating a given one of said functional modules from the others of said functional modules, said given one of said functional modules being taken from the group consisting of said locking and recocking module, said stock or handle module, said containment module, and said cartridge lifting and firing mechanism module;

providing a substitute module for said given one of said functional modules; and reassembling said weapon with said given one of said functional modules replaced by said substitute module, wherein said substitute module is of a type different from the type of said given one of said functional modules.

22. A method for using a modular portable weapon comprising:

assembling a plurality of functional modules to a supporting module constituted by the barrel of the weapon and by a sheath or barrel extension rearward of said barrel, said modules being functionally mutually independent, said modules including a locking and recocking module, a stock or handle module, a containment module, a magazine module, and a cartridge lifting and firing mechanism module, said locking and recocking module including a breech-lock and a locking head, wherein the assembling of said functional modules to said supporting module includes connecting said stock or handle module directly to a rear end of said sheath or barrel extension, inserting said locking and recocking module into said sheath or barrel extension, and connecting said containment module directly to said barrel at a location forward of said sheath or barrel extension;

at least partially disassembling the assembled weapon, the disassembling including separating a given one of said functional modules from the others of said functional modules, said given one of said functional modules being taken from the group consisting of said locking and recocking module, said stock or handle module, said containment module, and said cartridge lifting and firing mechanism module;

providing a substitute module for said given one of said functional modules; and reassembling said weapon with said given one of said functional modules replaced by said substitute module, wherein said substitute module has dimensions different from corresponding dimensions of said given one of said functional modules.

23. The modular portable weapon according to claim 1 wherein said containment modular contains a magazine module.

* * * * *